US006125673A

United States Patent [19]

Luker

[11] Patent Number: 6,125,673

[45] Date of Patent: Oct. 3, 2000

[54] ELECTRONIC CYLINDER LOCK AND COMPUTER SECURITY SYSTEM

[75] Inventor: Graham James Luker, Sydney, Australia

[73] Assignee: Trimel Securities PTY Ltd., New South Wales, Australia

[21] Appl. No.: 09/349,328

[22] Filed: Jul. 8, 1999

[51] Int. Cl.[7] ..... E05B 47/06

[52] U.S. Cl. ..... 70/276; 70/278.3; 70/283.1; 70/386; 70/434

[58] Field of Search ..... 70/34, 278.2, 278.3, 70/279.1, 283, 283.1, 277, 386, 276, 432, 434; 292/144, 251.5, 252

[56] References Cited

U.S. PATENT DOCUMENTS

| | | | |
|---|---|---|---|
| 1,695,518 | 12/1928 | Watson | 70/277 |
| 2,177,996 | 10/1939 | Raymond | 70/386 |
| 2,525,344 | 10/1950 | Garniss | 70/386 |
| 3,500,670 | 3/1970 | Hawkins | 70/386 |
| 3,894,417 | 7/1975 | Tariyama | 70/277 X |
| 4,677,834 | 7/1987 | Hicks | 70/386 X |
| 4,807,454 | 2/1989 | Sengupta et al. | 70/386 X |
| 5,121,618 | 6/1992 | Scott | 70/386 X |
| 5,447,047 | 9/1995 | Lin | 70/276 X |
| 5,791,176 | 8/1998 | Montesinos Alonso | 70/386 X |

FOREIGN PATENT DOCUMENTS

| | | | |
|---|---|---|---|
| 407023 | 6/1974 | U.S.S.R. | 70/386 |

*Primary Examiner*—Lloyd A. Gall
*Attorney, Agent, or Firm*—Jacobson & Johnson

[57] ABSTRACT

There is a lock for a gaming machine or other device. The lock has a plug 3 rotatable in a cylinder 1 between latched and unlatched positions. There are rolling members 9, 9A which at the latched position are radially displaceable within aligned plug and cylinder recesses 10, 11 between an outer locking position wherein said rolling member extends across a shear face 10A separating said plug 3 and cylinder 1 to hold the plug in the latched position and an inner unlocked position wherein the rolling members 9, 9A are substantially within the plug recess 10. There is a plunger movable axially within the plug 3 between a first position wherein the rolling members 9, 9A are retained in the locking position and a second position in which the rolling members 9, 9A are movable inward from the locking position to the unlocked position to allow rotation of the plug 3 from the latched to the unlatched positions.

9 Claims, 2 Drawing Sheets

ELECTRONIC CYLINDER LOCK AND COMPUTER SECURITY SYSTEM

FIELD OF INVENTION

This invention relates to security locks. More particularly although not exclusively it discloses an electronically activated cylinder lock.

BACKGROUND OF THE INVENTION

In many establishments such as casinos a large number of key operated cylinder locks are used. Existing cylinder locks typically comprise a rotatable plug or core within a nonrotating cylinder which is secured to the lock body. The rotatable plug is releasably secured against rotation by means of locking pins which are spring loaded to extend across the shear plane between the plug and cylinder. The pins are activated by a coded key which when inserted into the plug aligns ends of the locking pins with the shear plane such that said plug may be rotated to disengage a cam tail or other latch mechanism. Subsequent removal of the key after returning the plug to its latched position releases the pins to secure the plug against further rotation. The disadvantage of these prior art systems is that when a coded key is lost the security of the establishment can only be restored by rekeying all the locks for which it was used. In casinos or other establishments having a large number of poker machines, each fitted with several locks the cost of this is considerable.

SUMMARY OF THE INVENTION

It is therefore an object of this invention to ameliorate the aforementioned disadvantages and accordingly a lock is disclosed for a gaming machine or other device, said lock having a plug rotatable in a cylinder between latched and unlatched positions, at least one rolling member which at the latched position is radially displaceable within aligned plug and cylinder recesses between an outer locking position wherein said rolling member extends across a shear face separating said plug and cylinder to hold said plug in said latched position and an inner unlocked position wherein said rolling member is substantially within said plug recess and plunger means movable axially within said plug between a first position wherein said rolling member is retained in said locking position and a second position in which said rolling member is movable inward from said locking position to said unlocked position to allow rotation of said plug from said latched to said unlatched position.

Preferably said plunger is movable by a solenoid operating against a spring bias.

Preferably said rolling member is biased to said outer locking position by a magnet.

It is further preferred that said at least one rolling member comprise a ball.

BRIEF DESCRIPTION OF THE DRAWINGS

Two currently preferred embodiments of this invention will now be described with reference to the attached drawings in which.

DETAILED DESCRIPTION

Figure 1:
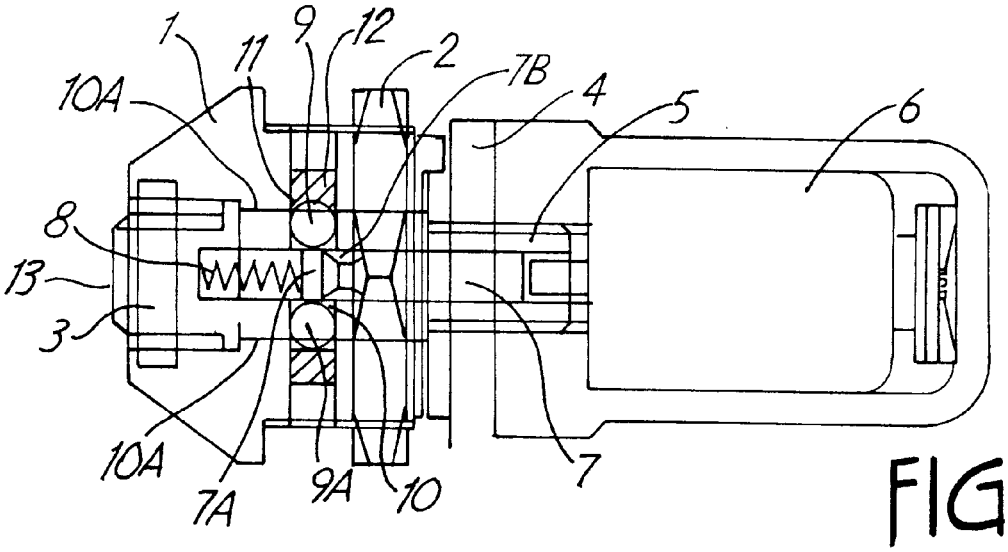
FIG. 1 is a schematic cross-sectional view of a cylinder lock according to this concept in the latched configuration.
Figure 2:
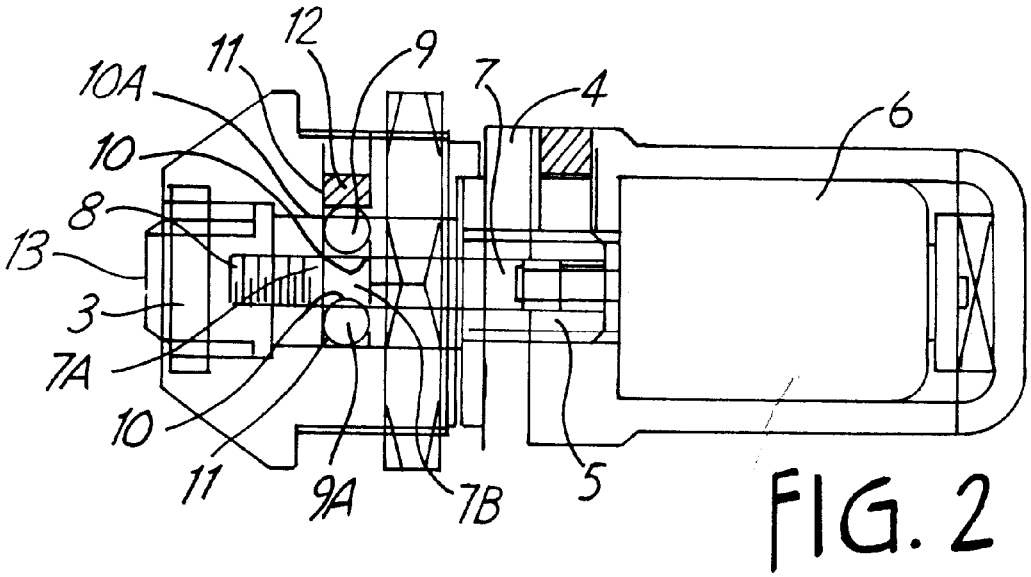
FIG. 2 shows the device of FIG. 2 in a configuration where the plug is free to rotate.

Referring first to FIGS. 1 and 2 the lock may comprise a cylinder 1 which is securable within an aperture in a door housing or the like (not shown) by means of a nut 2. A rotatable plug 3 extends axially through the cylinder and engages a cam tail 4 or other latch mechanism. Located behind the cam tail on a retaining bush 5 is a solenoid 6 which is remotely operable from any suitable form of personnel identification means such as a card reader or the like (not shown). There is a plunger 7 axially slidable within the plug 3 against the biasing force of a spring 8 at one end and the action of the solenoid 6 at the other. Two balls 9 and 9A are each disposed in respective adjacent recesses 10 and 11 in the plug and cylinder. These balls are radially displaceable between the outer locking positions shown in FIG. 1 whereby they extend across the shear plane 10A between the plug and cylinder, and the inner position occupied by the lower ball 9A in FIG. 2 which is completely within the plug recess 10 and thus clear of the shear plane.

In the configuration shown in FIG. 1 the solenoid is without power so that the spring 8 is free to push the plunger 7 to the right. This locates the end 7A of the plunger within the plug recess 10 so as to contain the balls in the outward locking position across the shear plane. Rotation of the plug 3 is thus prevented. When the solenoid is energised as shown in FIG. 2 it moves the plunger 7 tb the left against the force of the spring 8 so that a niche 7B behind the end 7A aligns with the plug recess to provide space therein for the balls. Preferably the balls are initially held by magnets 12 in the outer position notwithstanding this repositioning of the plunger. The recesses 10 and 11 however are shaped so that the plug then becomes free to rotate to an unlatched position by virtue of the balls rolling inward to locate wholly within the plug recess and plunger niche. Subsequent return of the plug to the latched position of FIG. 1 allows the balls again to move outward under the attraction of the magnets and the plunger to return to the right under the action of the spring as the solenoid is de-energised. This novel arrangement provides a mechanical sensing point for the user to locate the plug back to the latched position before removing the key and also avoids the requirement of any mechanical linkage operating off the plunger. The latter feature allows a relatively small and low power solenoid to be used. Indeed, it will be noted that other than the spring 8 virtually no mechanical forces oppose the axial movement of the plunger.

Although not shown in the drawings it is envisaged that the solenoid would be activated by any suitable form of card reader or other personnel identification means. While the invention is not limited to the particular embodiment shown the plug as mentioned earlier is adapted to be rotated by insertion of a noncoded key into the front face 13. Loss of such key would therefore not compromise the security of the lock and loss of an identity card would merely require reprogramming of the identification reader which would be faster and cheaper than the current cost of rekeying individual locks.

Figure 3:
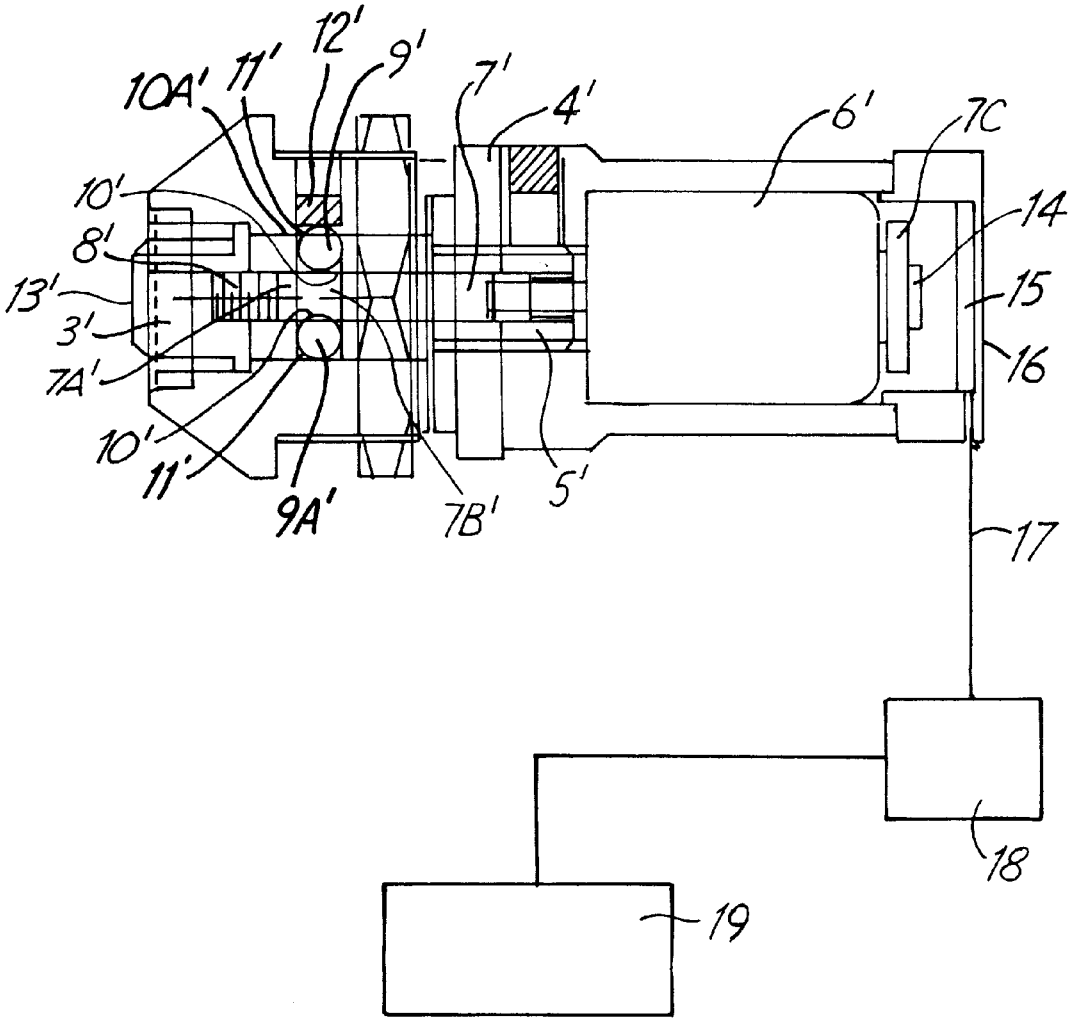
FIG. 3 shows a second embodiment of a cylinder lock according to this invention adapted to be used as part of a computer security system for gaming machines.

With the second embodiment of the invention shown in FIG. 3 the main components of the lock that correspond in function to those of the first embodiment are indicated by the same number but with the addition of an accent (').  This second embodiment includes a carbon impregnated rubber pad 14 or the like fitted to the end 7C of the solenoid plunger 7' remote from the lock. A circuit board 15 is also fitted within an end cap 16 so as to be spaced from the pad 14 when the solenoid is energised and the lock is disengaged as shown. Upon de-energisation of the solenoid and engagement of the lock (as described earlier) the plunger moves to the right under the force of the spring 8'. In doing so the pad 14 bridges surface contacts on the face of the circuit board 15 to initiate a signal which is sent via wires 17 to a remote encoder circuit 18. This signal thus indicates whether the solenoid 6' is energised or de-energised and thus the status of the lock. The encoder circuit in turn sends confirmation of the lock status (ie. engaged or disengaged) to a central computer 19.

Preferably an anti-tamper signal in the form of a continuous pulse is also applied to the circuit board 15 by the encoder circuit 18 so as to continually check and confirm the status of the lock. Any change in status is signalled to the central computer 19.

When it is required to operate the lock the necessary signal is preferably initiated at the computer 19 and transmitted back through the encoder circuit 18 to the solenoid 6'.

It is envisaged that the aforementioned system would be applied with great advantage to banks of poker machines, pin ball machines or other gaming machines.

At present in clubs, casinos or the like where large numbers of poker machines are installed all the security locks (which can number up to eight per machine) are operated by mechanical keys. Also, there is currently no feedback to any central monitoring system to indicate the status of any particular lock. Further, if a mechanical key is lost rekeying of all machines is necessary.

With a locking system according to this embodiment all the locks in a given machine are monitored by a single encoder circuit. Where large numbers of poker machines are installed the respective encoder circuits report to and are controlled by the central computer so that the numerous locks even within individual machines are operated independently.

Preferably any suitable electronic key medium would be used to operate the locks via this central computer so that loss of a key would simply require reprogramming of the computer rather than mechanical rekeying of all the locks.

It is also to be understood that this invention is not limited to the use of the balls 9, 9A, 9' and 9A' as shown for the preferred embodiments. A lock according to this invention may for example be adapted to use cylindrical pins in place of such balls.

What is claimed is:

1. A security lock for a gaming machine or other device, said lock having a plug rotatable in a cylinder between latched and unlatched positions, at least one rolling member which at the latched position is radially displaceable within aligned plug and cylinder recesses between an outer locking position wherein said rolling member extends across a shear face separating said plug and cylinder to hold said plug in said latched position and an inner unlocked position wherein said rolling member is substantially within said plug recess and plunger means movable axially within said plug between a first position wherein said rolling member is retained in said locking position and a second position in which said rolling member is movable inward from said locking position to said unlocked position to allow rotation of said plug from said latched to said unlatched position, said plunger means being axially opposed to a first key receiving face of the plug and said plunger means being movable by a solenoid against the biasing force of a spring.

2. The security lock as claimed in claim 1 wherein when said solenoid is de-energised said plunger means is moved to said first position by said biasing force and when said solenoid is energised said plunger means is moved to said second position.

3. The security lock as claimed in claim 2 wherein said recesses are shaped so that when the solenoid is energised to move said plunger means to said second position said rolling member rolls inward to said unlocked position as the plug is rotated in said cylinder from said latched position to said unlatched position.

4. The security lock as claimed in claim 3 wherein when said plug is rotated from the unlatched to the latched position said rolling member is drawn outward to said locking position by the attraction of a magnet in said cylinder.

5. The security lock as claimed in claim 4 wherein there are two rolling members which comprise steel balls.

6. The security lock as claimed in claim 5 wherein said solenoid is remotely operable by a personnel identification means.

7. The security lock as claimed in claim 6 wherein a sensing means is fitted to said solenoid whereby the status of said lock is signalled to an encoder circuit and central computer.

8. The security lock as claimed in claim 7 wherein said sensing means comprises a circuit board fitted within an end cap of the solenoid so that when said solenoid is de-energized a pad fitted to the end of the plunger means bridges contacts on said circuit board to initiate a signal to said encoder circuit.

9. The security lock as claimed in claim 8 wherein said encoder circuit is adapted to apply an anti-tamper signal to the circuit board so as to continuously check and confirm the status of said lock with any change in status being signalled to said central computer.

* * * * *